US007290760B1

(12) United States Patent
Lindsay

(10) Patent No.: US 7,290,760 B1
(45) Date of Patent: Nov. 6, 2007

(54) ROTATING, POSITIONING AND TILTING MECHANISM WITH CAM LOCKS

(76) Inventor: Steven James Lindsay, 3714 W. Cedar Hills Dr., Kearney, NE (US) 68845

( * ) Notice: Subject to any disclaimer, the term of this patent is extended or adjusted under 35 U.S.C. 154(b) by 0 days.

(21) Appl. No.: 11/595,650

(22) Filed: Nov. 10, 2006

(51) Int. Cl.
*B25B 1/22* (2006.01)

(52) U.S. Cl. ..... 269/75; 269/43

(58) Field of Classification Search ..... 269/71–75, 269/95, 43, 45
See application file for complete search history.

(56) References Cited

U.S. PATENT DOCUMENTS

| | | | | | |
|---|---|---|---|---|---|
| 86,173 | A | * | 1/1869 | Dickenson | 403/123 |
| 132,127 | A | | 10/1872 | Wilcox | |
| 269,708 | A | | 12/1882 | Thompson | |
| 274,242 | A | | 3/1883 | Plummer | |
| 340,429 | A | * | 4/1886 | Maynard | 81/4 |
| 420,968 | A | | 2/1890 | Seaman | |
| 420,969 | A | | 2/1890 | Seaman | |
| 420,970 | A | | 2/1890 | Seaman | |
| 481,238 | A | | 8/1892 | Muehlmatt | |
| 565,425 | A | | 8/1896 | Donlevy et al. | |
| 790,540 | A | | 5/1905 | Valentine | |
| 829,771 | A | | 8/1906 | Francis | |
| 911,667 | A | | 2/1909 | Muehlmatt | |
| 983,091 | A | | 1/1911 | Skow et al. | |
| 1,333,432 | A | | 3/1920 | Maller | |
| 1,397,293 | A | | 11/1921 | Plummer | |
| 1,555,774 | A | | 9/1925 | Thompson | |
| 1,665,819 | A | | 4/1928 | Plummer | |
| 1,697,117 | A | | 1/1929 | Hilstad et al. | |
| 1,936,968 | A | | 11/1933 | Neal | |
| 1,981,253 | A | | 11/1934 | Schulz | |
| 2,070,025 | A | | 2/1937 | Phillips | |
| 2,260,995 | A | | 10/1941 | Kruczek | |
| 2,310,025 | A | | 2/1943 | Giern et al. | |
| 2,371,435 | A | | 3/1945 | Galorneau | |
| 3,815,892 | A | * | 6/1974 | Tulk | 269/75 |
| 4,066,231 | A | | 1/1978 | Bahner et al. | |
| 4,086,704 | A | | 5/1978 | Masaichi | |
| 4,243,212 | A | | 1/1981 | Bunyea et al. | |
| 4,306,709 | A | * | 12/1981 | Hurn | 269/75 |
| 4,352,489 | A | * | 10/1982 | Wagster | 269/75 |
| 4,702,465 | A | | 10/1987 | McConnell | |
| 4,744,552 | A | | 5/1988 | Glaser | |
| 5,224,692 | A | * | 7/1993 | Anderson et al. | 269/75 |
| 6,071,031 | A | | 6/2000 | Bailey | |
| 6,698,738 | B2 | * | 3/2004 | Wiebe | 269/75 |
| 6,978,989 | B2 | | 12/2005 | Glaser et al. | |
| 7,097,170 | B2 | | 8/2006 | Glaser et al. | |

OTHER PUBLICATIONS

GRS Corporation, GRS Positioning Vise, Document date: Mar. 2, 2005, Petinent pp. 1 and 2, Glendo Corporation, USA.
Photos by applicant of pertinent elements of a "GRS Positioning Vise", Photographed Date: Nov. 4, 2006.

* cited by examiner

*Primary Examiner*—Lee D. Wilson

(57) ABSTRACT

A locking positioning mechanism utilizing cam locks. The invention provides lever operated cam locking mechanisms for locking a rotating, tilting and positioning vise.

15 Claims, 8 Drawing Sheets

ROTATING, POSITIONING AND TILTING MECHANISM WITH CAM LOCKS

BACKGROUND OF THE INVENTION

1. Field of Invention

The invention relates to a method of locking a positioning mechanism, more particularly, a method of locking a rotating, tilting and positioning vise with cam profile shaped locks.

2. Description of Prior Art

The traditional hand engraving vise which has been in existence since the nineteenth century, consists of a ball base resting in a doughnut type cradle. The top half of the ball is made to pivot on a center axis. On top of this are the vise jaws. When the engraver, jeweler or craftsman desires to hand engrave an arc on an object that is clamped in the jaws, he simply turns the vise with one hand, while the other hand holds the engraving point on the surface of the object that is being engraved. The location of the rotating object being engraved has a direct affect on the degree of difficulty in engraving an arc. The location of the rotating pivot position depends on where the object is clamped in the jaws of the vise. An arc is easiest to engrave when it has its center location closest to the center pivot position of the rotating vise. Engravers and jewelers therefore become accustomed to unclamping, moving and reclamping the object in the vise jaws many times in the course of a project. Unfortunately, clamping and unclamping to position the object in reference to the vise pivoting location can become a problem since the objects engravers and jewelers work on are often delicate and can be damaged if clamped incorrectly. In addition, a lot of time is used unclamping and clamping. Another example of the need to position a working area of an object in the center of a rotating vise is when delicate hand working operations are executed with a microscope. The microscope is centered over the rotating pivot position of the vise. The field of view through the microscope is limited and in order to keep a particular spot in view, the axis of rotation needs to stay in the center of the field of view of the scope, otherwise the area being viewed will swing out of view when the vise is rotated.

Tilting prior art engraving vises utilized a partial sphere for the bottom half of the rotating assembly set in a cradle base made of materials such as rubber and leather. The weight of the vise and the material the cradle is made of determines how much grip is on the sphere to prevent the vise from titling unexpectedly. This method of holding the tilting vise can be unpredictable and the entire vise assembly has been known to fall and tilt unexpectedly.

Disclosed in publication titled GRS POSITIONING VISE by GRS Corporation as well as photographs by applicant of a disassembled GRS Corporation positioning vise is a rotating positioning vise. The vise jaw apparatus on top of this prior art vise is made to slide around for positioning and then lock. The locking mechanism utilizes one spring in earlier models for holding the lock state. Later models used two springs. The one or two springs are connected to a lever. This lever has detent holes in it. There are two steel ball bearings fixed in position in the block that are spaced the same distance as the detent holes in the lever. When the positioning is locked, the holes in the lever do not line up with the holes. In this state the lever is pushing against a friction plate to lock the positioning of the vise. To unlock a user moves the spring loaded lever and the detent holes in the lever then align with the two ball bearings in block. This allows the lever to be lowered and thus loosens the pressure on the friction plate that allows the user to position the vise. The lever requires two hands to overcome the resistance of the springs to unlock. Additionally there is a wear point on a "lock button" described in the GRS Corporation publication. When it is worn, the mechanism will not lock well and requires repair shims. As is true to other prior art, this vise does not have a lock mechanism to lock the tilt.

In short, an improved positioning vise should have a unique and simple method to lock the positioning as well as the tilting movements. The locking mechanisms should be easily and quickly locked and unlocked at will by the user without a lot of resistance effort or needing to use both hands to lock and unlock. The locks should take up any wear themselves and not require repair shims.

OBJECTS AND SUMMARY OF THE INVENTION

It is the object of this invention to provide lever operated cam locking mechanisms for an engraver's, jeweler's or craftsman vise, however the nature of the invention could be utilized for other applications. The small lock handles on this vise application can be operated with one hand. The mechanical advantage is that eccentric cams allow a lot of mechanical advantage and holding power without a lot of resistance for a user to lock and unlock the mechanisms.

BRIEF DESCRIPTION OF THE DRAWINGS

The preferred embodiment of the invention is described below with reference to attached drawing figures, wherein.

DETAILED DESCRIPTION OF THE PREFERRED EMBODIMENT

Figure 1:
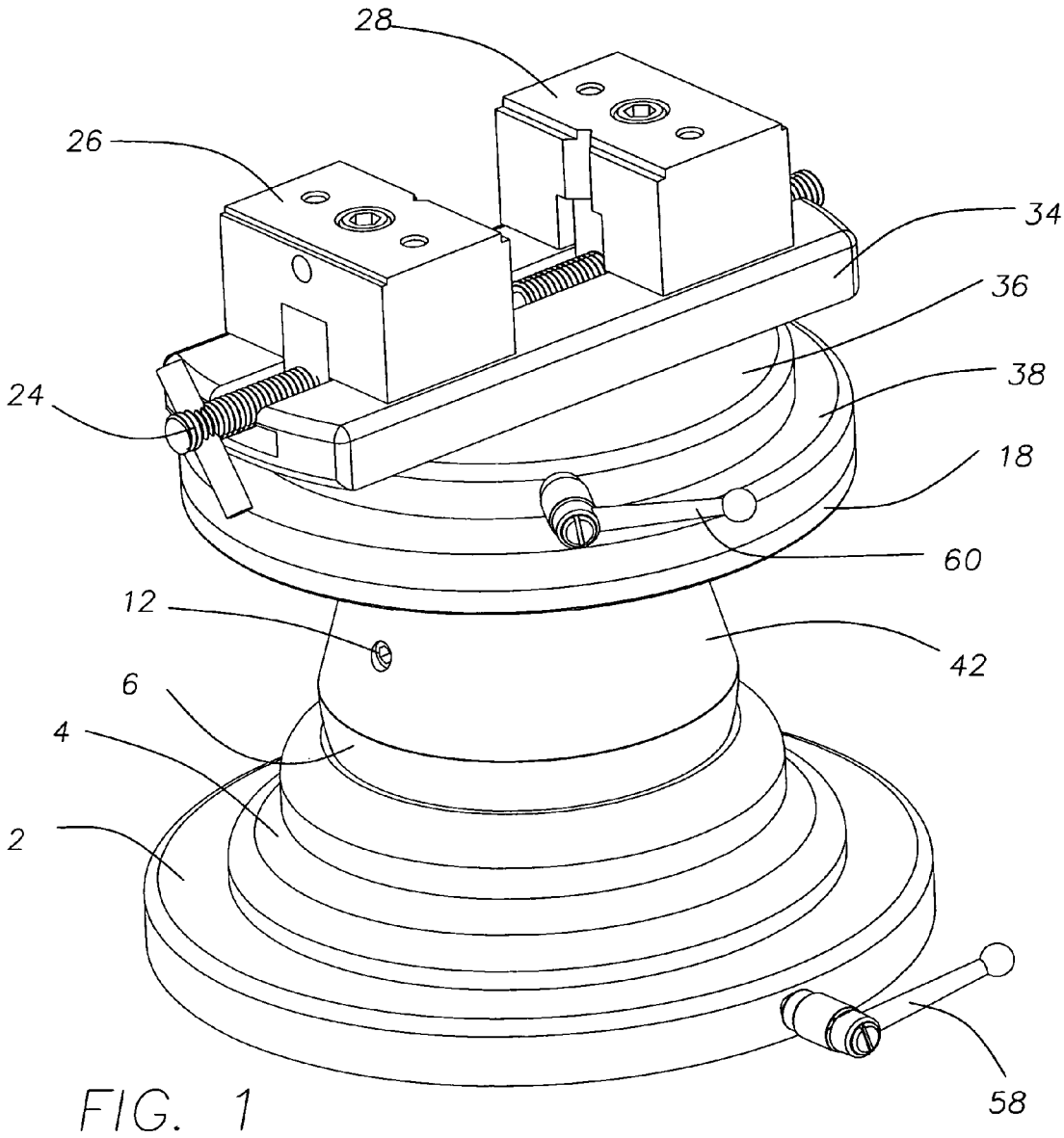
FIG. 1; is a perspective view of a rotating, positioning and tilting vise with cam locks constructed in accordance with the present invention.
Figure 2:
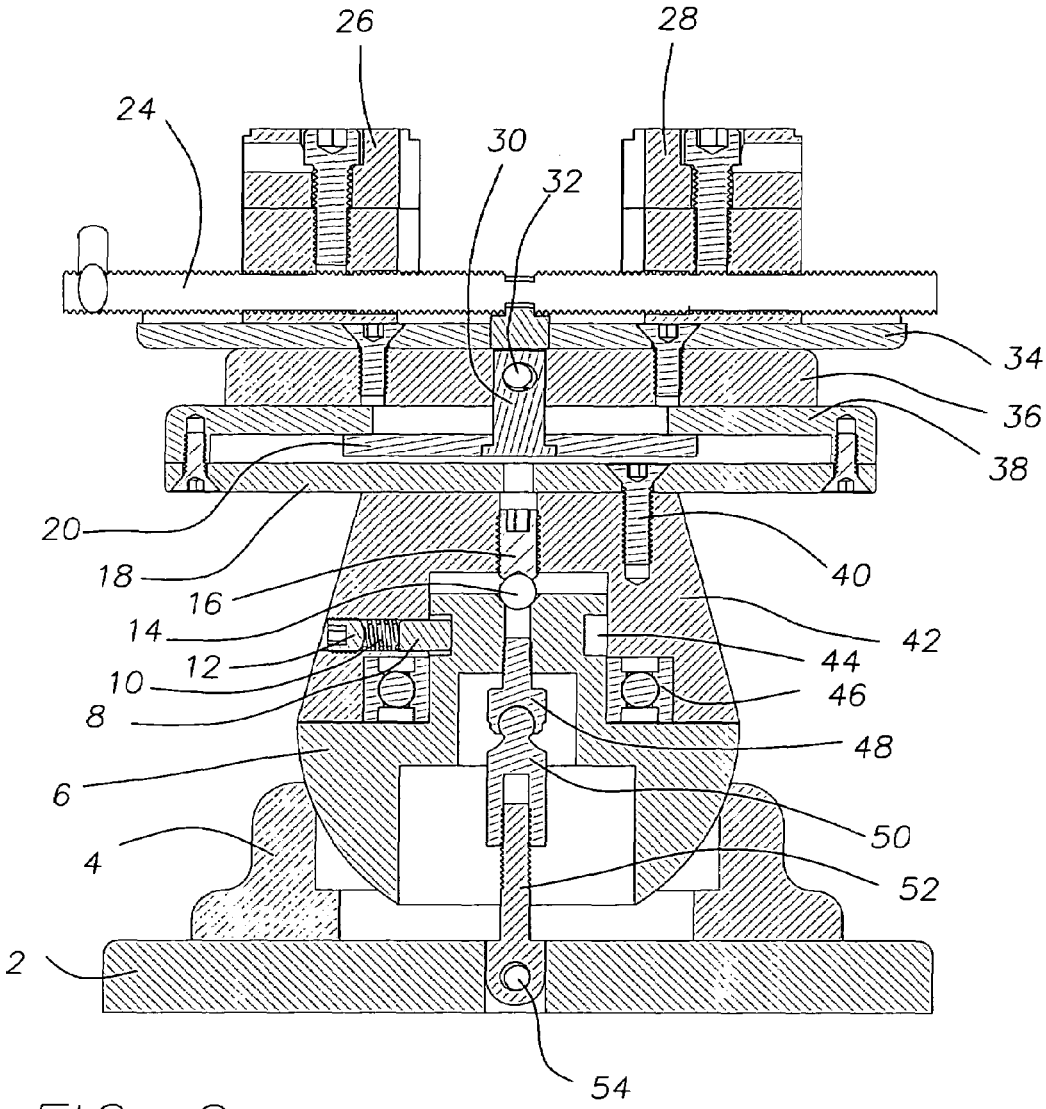
FIG. 2; is a front sectional view of the rotating, positioning and tilting vise with cam locks constructed in accordance with the present invention.
Figure 3:
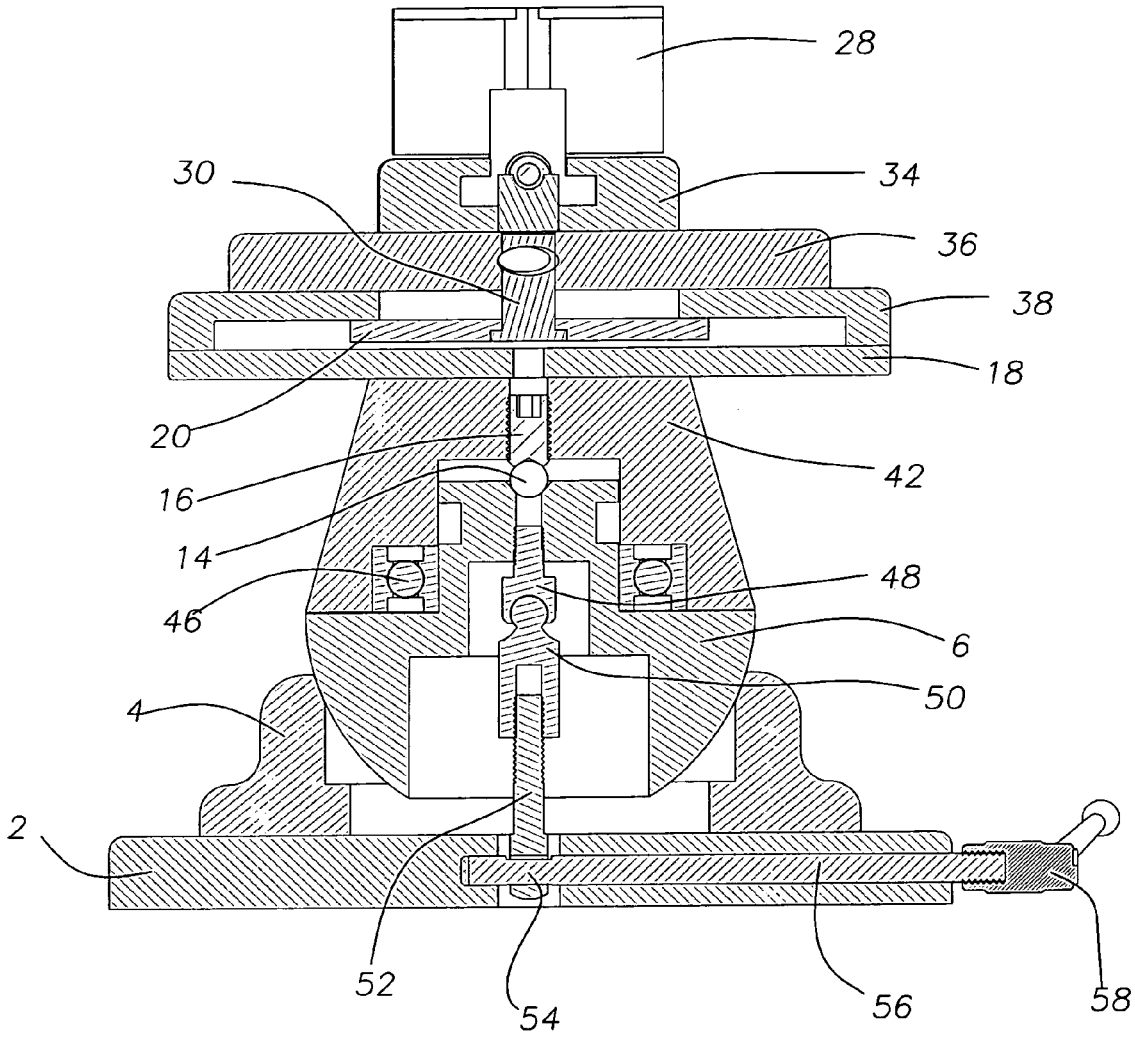
FIG. 3; is a side sectional view of the rotating, positioning and tilting vise with cam locks constructed in accordance with the present invention.
Figure 6:
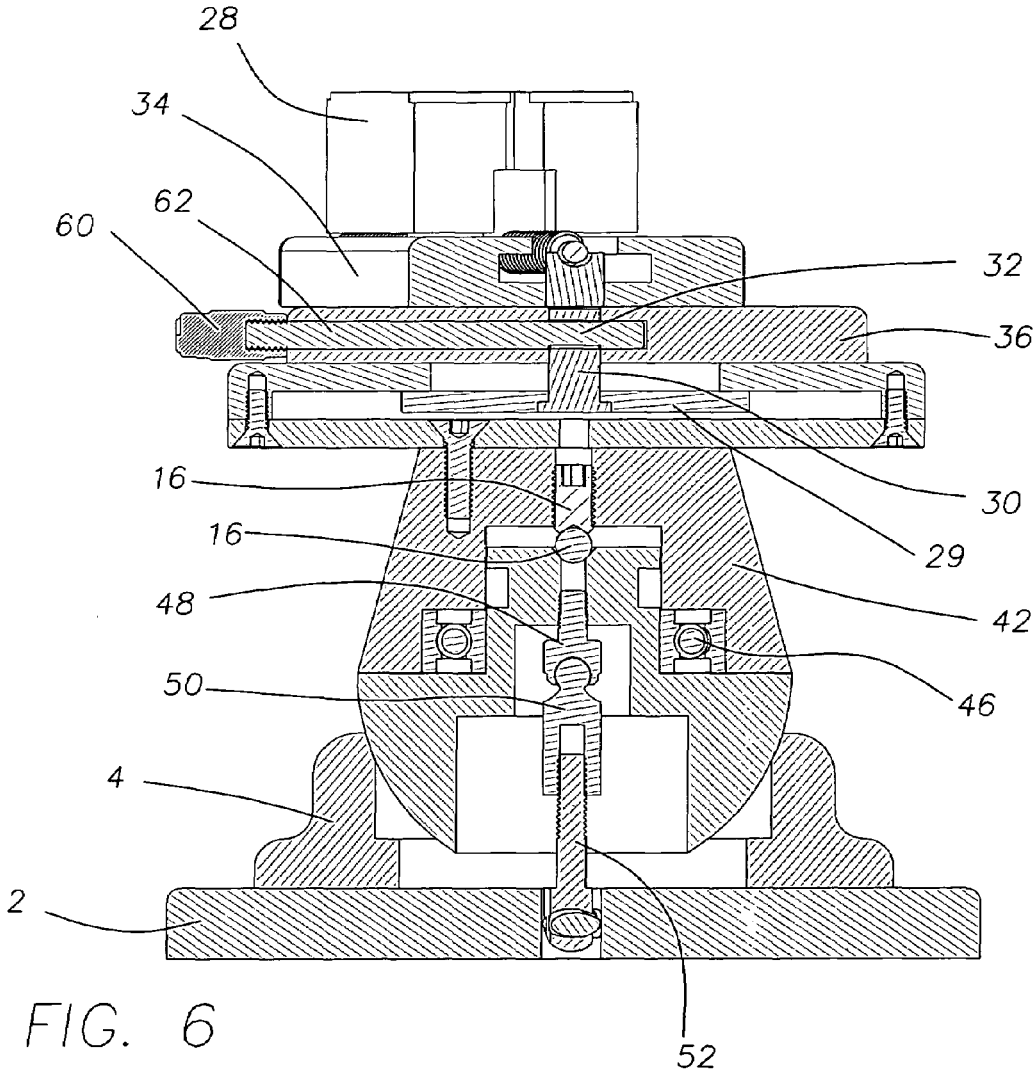
FIG. 6; is a sectional view split along EE illustrated in FIG. 5.

A rotating, positioning and tilting vise with cam locks in accordance with the present invention is illustrated in FIG. 1. Referring to FIG. 1, FIG. 2, and FIG. 3, the embodiment consists of a base-plate 2 that includes a hole through its edge for a slip fit to tilt-lock-rod 56 (FIG. 3). Base-plate 2 also includes a hole through its center providing for eyebolt 52. Tilt-lock-handle 58 is fixed in position at one end of tilt-lock-rod 56, the other end fits through a hole in eyebolt 52. At the location along tilt-lock-rod 56 where it fits through eyebolt 52 is a cam-shape-profile 54. Cradle 4 is fixed in place on base-plate 2. Ball-base 6 sets in cradle 4 and can tilt or move around in cradle 4 in a manner similar to a ball and socket. Roller-bearing 46 is press fit over the protruding boss of ball-base 6. The outside diameter of roller-bearing 46 is press fit into the largest inside diameter of block 42. Setscrew 16 has a dimple on its end for ball-bearing 14 to fit. The top of block 42 also has a chamfer in it center for nesting ball bearing 14. Roller-bearing 46 and ball bearing 14 allows block 42 to rotate freely around cradle 4. Referring to FIG. 2, brake-screw and spring 10 pushes against brake-drag 8 which in turn pushes against ball-base 6 at the location of brake-recess 44 forming an adjustable drag brake. Plate 18 is bolted in place on top of block 42 with three bolts. One of which (bolt 40) is illustrated in FIG. 2. Lock-plate 38 is bolted in place on top of plate 18. Riser 36 sets on top and can slide around on top of lock-plate 38. In the center of riser 36 is a hole to fit pressure-pin 30 with a sliding fit. The bottom of pressure-pin 39 has a head that fits the center of pressure-plate 20 for the purpose of not allowing pressure-pin 39 from being pulled through. Note: Riser 36 can slide around on top of lock-plate 38 within the limitation of what pressure-pin 39 can move around within the hole in the center of lock-plate 38. Referring to FIG. 6, riser 36 includes a hole through its edge for a slip fit to positioning-lock-rod 62. Rotation-lock-handle 60 is fixed in position at one end of positioning-lock-rod 62, the other end fits through a hole in pressure-pin 30. At the location along the rod where it goes through pressure-pin 30 is a cam-shape-profile 32. Referring to FIG. 1, FIG. 2, and FIG. 3, bolted to the top of riser 36 is jaw-slide 34. Jaws 26 and 28 fit in the top of jaw-slide 34 and slide together and apart by the use of jaw-screw 24.

Operation

Figure 4:
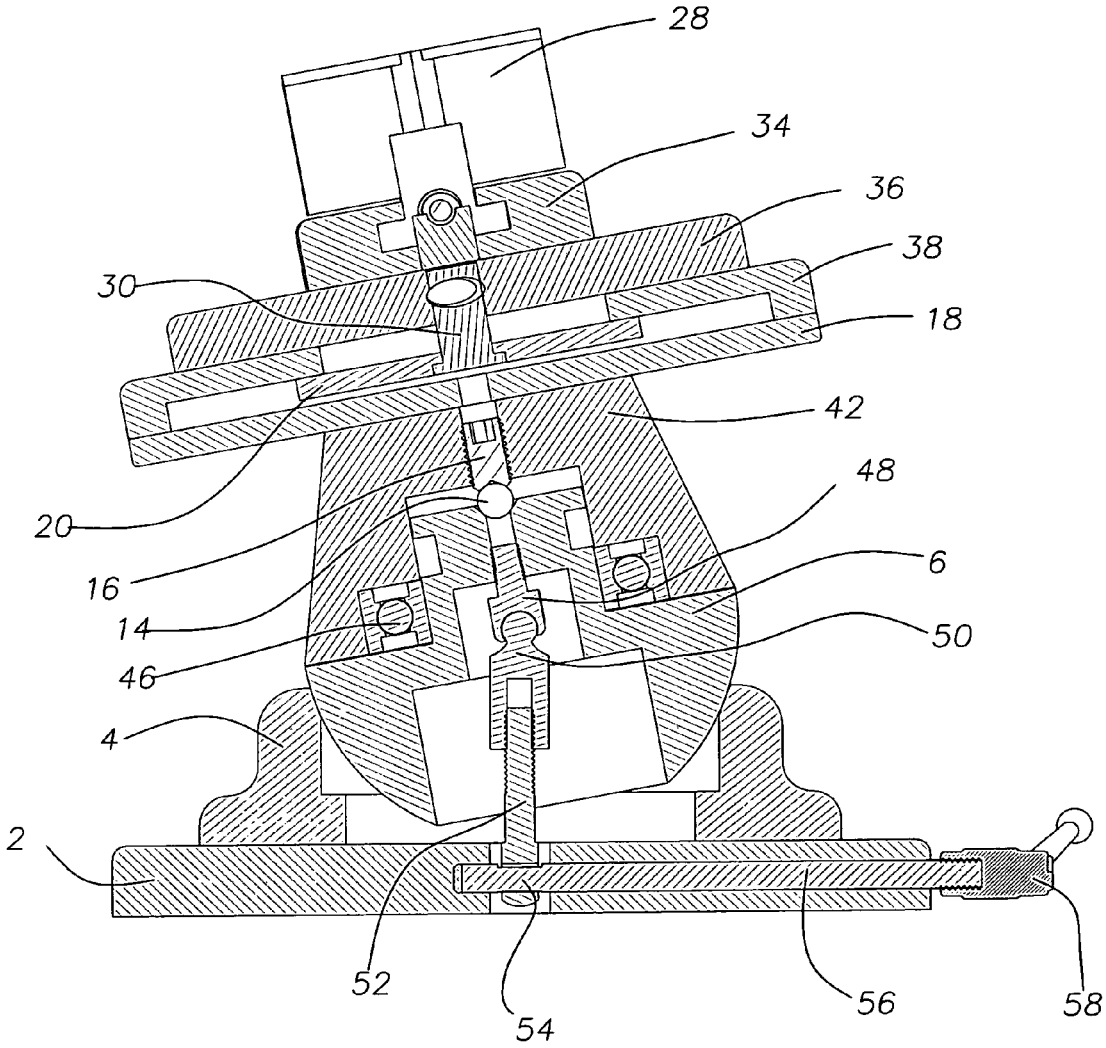
FIG. 4; is the same view as FIG. 3, differing in that the vise is depicted tilted.
Figure 5:
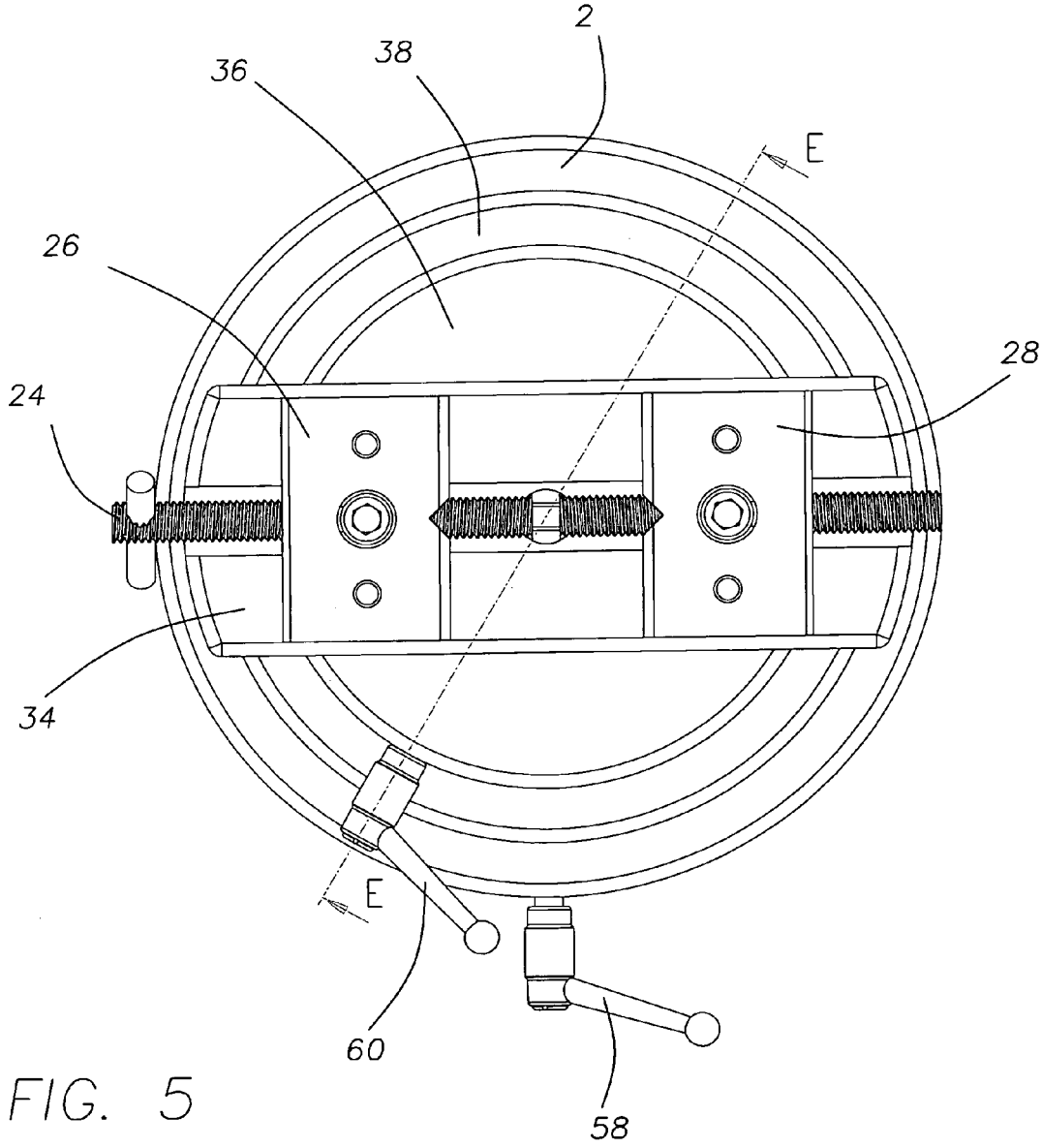
FIG. 5; is a top view of the rotating, positioning and tilting vise with cam locks constructed in accordance with the present invention.

Referring to FIG. 1, during use, by a jeweler, engraving artist or craftsman, an object being worked on is clamped in jaws 26 and 28 using jaw-screw 24. The user turns or spins the vise as needed by placing and griping his or her hand on block 42. When needed, the user can tilt the vise by loosing tilt-lock-handle 58, tilting the vise and then tightening tilt-lock-handle 58. FIG. 4 illustrates the vise in a titled position. The way the locking mechanism works is cam-shape-profile 54 is eccentric shaped and as it is turned to tighten, the cam's longer side begins to point down and pull down on eyebolt 52. The downward force is transferred through u-joint-ball 50, u-joint-socket 48 and finally to ball-base 6. Ball-base 6 is then pulled down tight within cradle 4 locking ball-base 6 in place.

Figure 7:
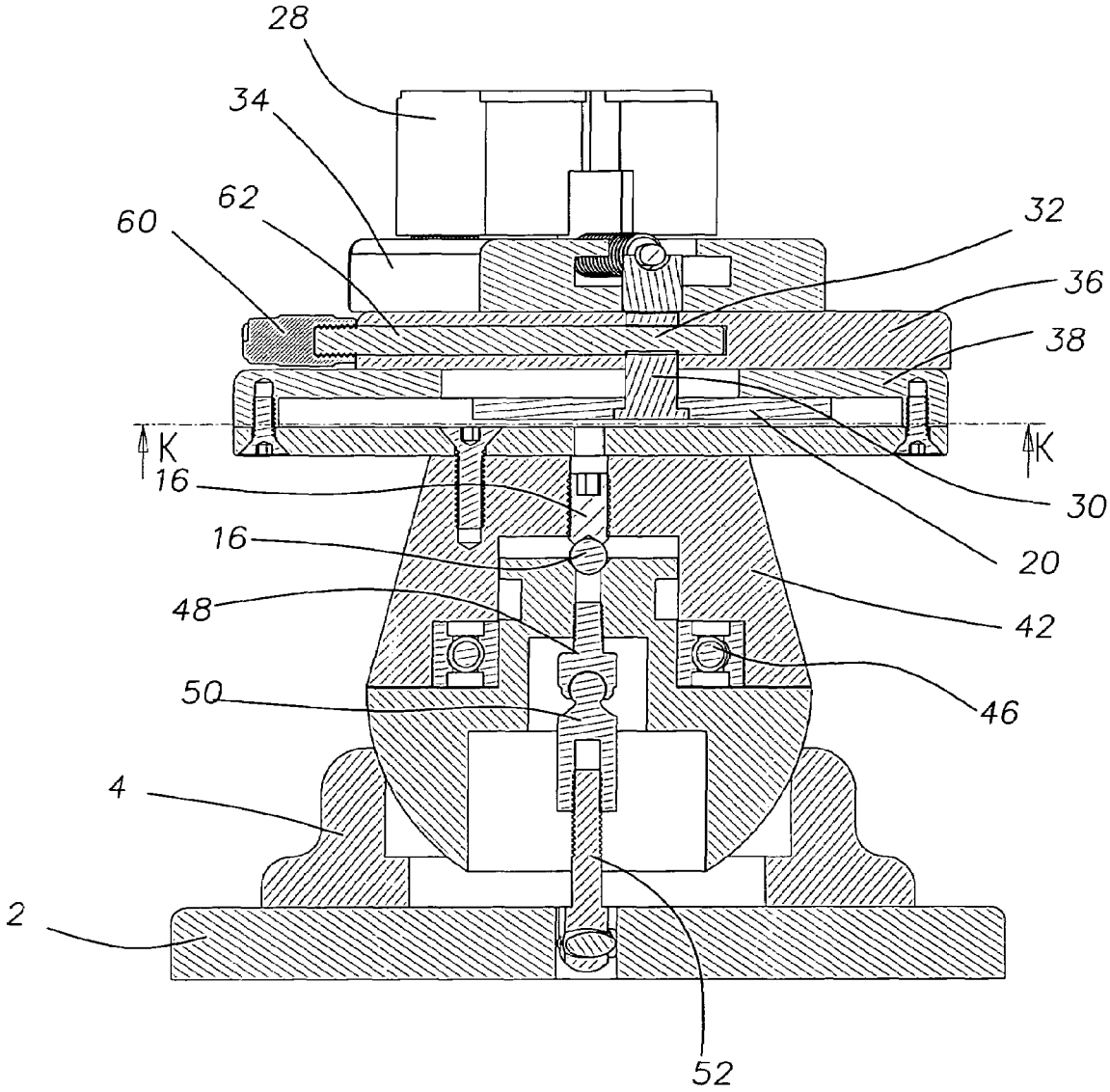
FIG. 7; is the same view as FIG. 6, differing in that the vise is depicted positioned to the right of center.
Figure 8:
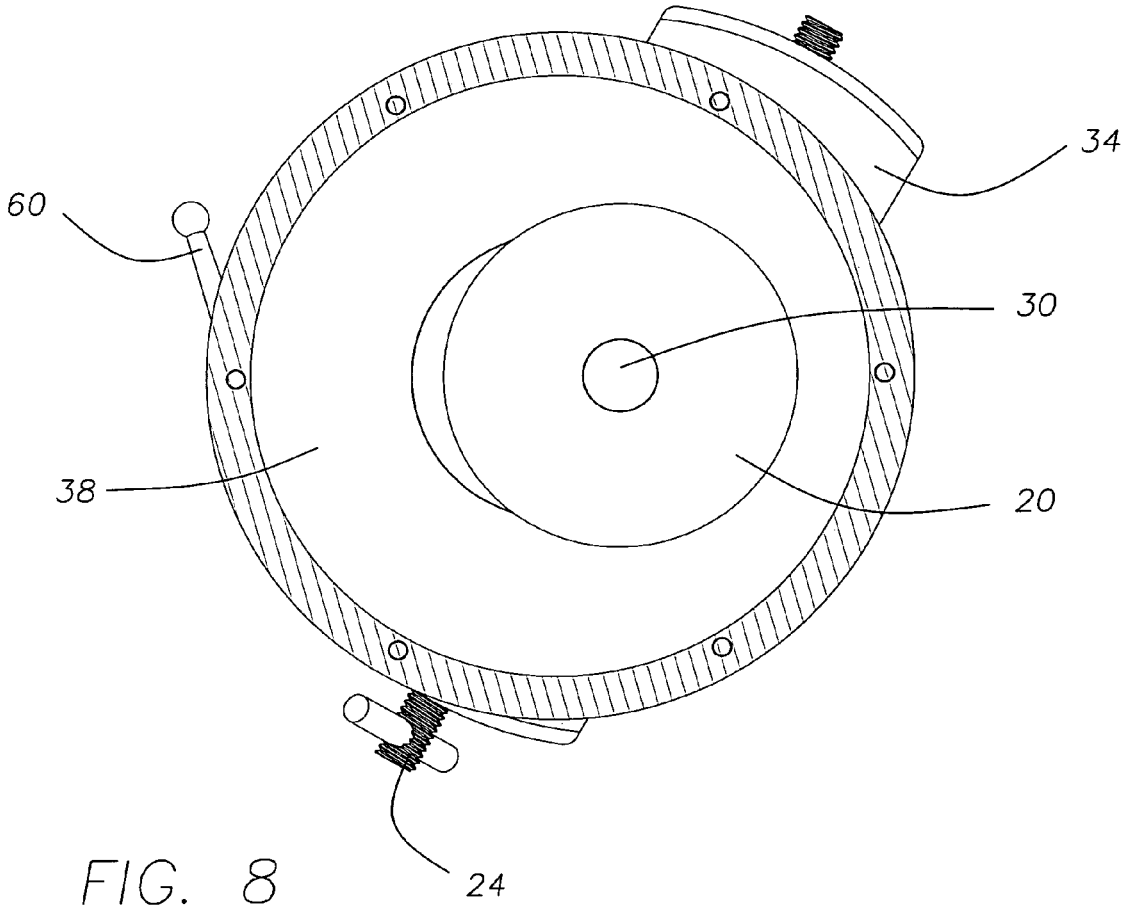
FIG. 8; is a sectional view split along KK illustrated in FIG. 7.

Referring to FIG. 1, when needed the user can position the top portion of the vise off center by loosing rotation-lock-handle 60, positioning the top portion and then tightening rotation-lock-handle 60. FIG. 6 illustrates the top portion of the vise centered while FIG. 7 illustrates the top portion of the vise positioned to the right. FIG. 8 is a section view cut along KK shown in FIG. 7 that helps illustrate the offset to the right of the top portion of the vise as well as pressure-plate 20.

Referring to FIG. 7, the way the locking mechanism functions is cam-shape-profile 32 is eccentric shaped and as it is turned, the cam begins to point up and pull up on pressure-pin 30 along with pressure-plate 20. The upward force of pressure-plate 20 against lock-plate 38 locks riser 36 and thus the assembly above this point in place.

Note: Cam-shape-profile 32 and cam-shape-profile 54 have been drawn as an eccentric shaped cam, meaning that their profile is round or circular and off center from the round rod they are made on. A cross section of cam-shape-profile 54 is illustrated in FIG. 2. Cam-shape-profile 32 is also illustrated in FIG. 2, however this cross sectional view isn't splitting cam-shape-profile 32 straight on and therefore it appears slightly oblong in the view. Cam-shape-profile 32 is however the same profile as cam-shape-profile 54. Other types of cam profiles such as a pear, egg, heart, drop or other shaped cam profiles will work equally as well for the invention.

CONCLUSION, RAMIFICATIONS, AND SCOPE

Accordingly, the reader will see that the invention provides a rotating, positioning and tilting vise that allows ease of freedom of movement for a jeweler, engraver or craftsman. The locking method is unique and yet a simple method to lock the positioning as well as tilting movements. The locking mechanisms are easily and quickly locked and unlocked at will by the user without a lot of resistance effort or needing to use both hands to lock and unlock. The mechanical advantage of eccentric cams allows a lot of holding power without a lot of resistance for a user to lock and unlock the mechanisms. Although the invention has been described with reference to the illustrated embodiment, it is noted that equivalents may be employed and substitutions made herein without departing from the scope of the invention as recited in the claims. For example: Eyebolt 52, u-joint-ball 50 and u-joint-socket 48 could be replaced with different linkages that would give the equivalent effect. For instance a cable or wire could be used here. The locking tilt and the top positioning lock could be used by themselves in an apparatus. Base-plate 2 and cradle 4 could be combined and made from one piece without departing from the scope of the invention. Although the device was made for jewelers, engravers, and craftsman, the invention can be used by other trades that would benefit from a locking tilting apparatus or a locking positioning apparatus.

Accordingly, the scope of the invention should be determined not by the embodiment illustrated, but by the appended claims and their legal equivalents.

I claim:

1. A positioning vise comprising:

a first positioning mechanism, said first positioning mechanism comprising of:

a ball-and-socket base assembly including a cradle and a member having an arcuate portion wherein the member having the arcuate portion is movably engaged within the cradle whereby the arcuate portion can move about multiple axes within the cradle, and a second positioning mechanism, said second positioning mechanism comprising of:

a rotatable plate having a central axis wherein the rotatable plate is operable to rotate about the central axis;

a bearing assembly positioned between said rotatable plate and said member having the arcuate portion;

a lock plate;

a pressure plate positioned between said rotatable plate and said lock plate;

a riser block positioned against and on the opposite side of said lock plate that said pressure plate is positioned on;

a pressure pin that spans from said riser block, through a hole in said lock plate, to said pressure plate;

a position lock rod having a length and that is in communication with and substantially perpendicular to said pressure pin;

a position lock lever connected to said position lock rod; and a first cam shaped member in communication with said pressure pin for the purpose of biasing said pressure plate tight against and thereby clamping said lock-plate in place when said position lock lever is turned.

2. The positioning vise of claim 1, further comprising:

a rotatable block containing said bearing assembly between said rotatable plate and said ball-and-socket base assembly.

3. The positioning vise of claim 1, further comprising:

a plurality of vise-jaws.

4. The positioning vise of claim 1, further comprising:

a linkage between said cradle and said member having an arcuate portion wherein the linkage is substantially centered within said member having an arcuate portion and said cradle;

a tilt lock rod substantially perpendicular to said linkage; and a second cam shaped member in communication with said linkage for the purpose of biasing said member having an arcuate portion tight into said cradle when said tilt lock rod is turned.

5. A positioning and holding apparatus comprising:

a cradle;

a member having an arcuate portion movably engaged within said cradle;

a rotatable plate mounted to said member and having a central axis wherein the rotatable plate is operable to rotate about the central axis;

a bearing assembly positioned between said rotatable plate and said member having the arcuate portion;

a lock plate;

a pressure plate positioned between said rotatable plate and said lock plate;

a riser block positioned against and on the opposite side of said lock plate that said pressure plate is positioned on;

a pressure pin that spans from said riser block, through a hole in said lock plate, to said pressure plate;

a position lock rod having a length and that is in communication with and substantially perpendicular to said pressure pin;

a position lock lever connected to said position lock rod; and a first cam shaped member in communication with said pressure pin for the purpose of biasing said pressure plate tight against and thereby clamping said lock-plate in place when said position lock lever is turned.

6. The positioning and holding apparatus of claim 5, further comprising:

a second lock mechanism operably associated with at least one of said member having the arcuate portion and said cradle to selectively lock the arcuate portion in a selected position.

7. The positioning and holding apparatus of claim 5, further comprising:

a rotatable block including said bearing assembly wherein the rotatable block is positioned between said rotatable plate and said member having the arcuate portion.

8. The positioning and holding apparatus of claim 5, further comprising:

a lead-screw; and at least two vise-jaws.

9. The positioning and holding apparatus 5, further comprising:

a linkage between said cradle and said member having an arcuate portion wherein the linkage is substantially centered within said member having an arcuate portion and said cradle;

a tilt lock rod substantially perpendicular to said linkage; and a second cam shaped member in communication with said linkage for the purpose of biasing said member having an arcuate portion tight into said cradle when said tilt lock rod is turned.

10. The positioning and holding apparatus of claim 5, wherein:

said bearing assembly positioned between said rotatable plate and said member having the arcuate portion whereby said rotatable plate is adapted to move separately from said movable engagement of said arcuate portion in said cradle.

11. A positioning vise comprising:

a cradle;

a member having an arcuate portion movably engaged within said cradle;

a linkage between said cradle and said member having an arcuate portion wherein the linkage is substantially centered within said member having an arcuate portion and said cradle;

a tilt lock rod substantially perpendicular to said linkage;

a first cam shaped member in communication with said linkage for the purpose of biasing said member having an arcuate portion tight into said cradle when said tilt lock rod is turned;

a rotatable block; and a bearing assembly positioned between said rotatable block and said member having the arcuate portion whereby said rotatable block is adapted to move separately from said movable engagement of said arcuate portion in said cradle.

12. The positioning vise of claim 11, further comprising:

at least two vise-jaws.

13. The positioning vise of claim 12, further comprising:

a lead-screw.

14. The positioning vise of claim 12, further comprising:

a slide mechanism positioned under said at least two vise-jaws for the purpose of moving said at least two vise-jaws off center from the center axis of said bearing assembly.

15. The positioning vise of claim 11, further comprising:

a lock plate;

a pressure plate positioned between said rotatable block and said lock plate;

a riser block positioned against and on the opposite side of said lock plate that said pressure plate is positioned on;

a pressure pin that spans from said riser block, through a hole in said lock plate, to said pressure plate;

a position lock rod having a length and that is in communication with and substantially perpendicular to said pressure pin;

a position lock lever connected to said position lock rod; and a second cam shaped member in communication with said pressure pin for the purpose of biasing said pressure plate tight against and thereby clamping said lock-plate in place when said position lock lever is turned.

* * * * *